US006464042B2

(12) United States Patent
Risch et al.

(10) Patent No.: US 6,464,042 B2
(45) Date of Patent: Oct. 15, 2002

(54) STRUT FOR COUPLING LINEAR DRIVE TO ELEVATOR CAR OR COUNTERWEIGHT

(75) Inventors: David Risch, Shanghai (CN); Johannes Kocher, Udligenswil (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/783,452

(22) Filed: Feb. 14, 2001

(65) Prior Publication Data

US 2001/0015306 A1 Aug. 23, 2001

(30) Foreign Application Priority Data

Feb. 18, 2000 (EP) ..... 00810138

(51) Int. Cl.[7] ..... B66B 1/34
(52) U.S. Cl. ..... 187/292; 187/289
(58) Field of Search ..... 127/289, 252, 127/414; 312/627, 135

(56) References Cited

U.S. PATENT DOCUMENTS 5,033,588 A * 7/1991 Nakai et al. ..... 187/289
5,062,501 A * 11/1991 Pavoz et al. ..... 187/289
5,300,737 A * 4/1994 Nakanski ..... 187/289
5,476,159 A * 12/1995 Cho ..... 187/289
5,501,300 A * 3/1996 Cho ..... 187/289
5,542,501 A * 8/1996 Ikejima et al. ..... 187/292

FOREIGN PATENT DOCUMENTS

EP 0 846 646 6/1998

* cited by examiner

*Primary Examiner*—Jonathan Salata
(74) *Attorney, Agent, or Firm*—MacMillan, Sobanski & Todd, LLC

(57) ABSTRACT

A direct drive apparatus for an elevator wherein a movable part of the direct drive, particularly a linear motor, is connected with ark elevator car or counterweight for transmission of compression and tension in the travel direction by a tension/compression strut with settable damping properties. The tension/compression strut includes first and second rods which lie on a longitudinal axis of the strut and extend into opposite ends of a sleeve. First and second nuts are threadably received in the ends of the sleeve. First and second spring elements are positioned in the sleeve abutting the first and second nuts respectively. A central spring element is positioned between first and second spring plates which abut the first and second spring elements respectively. Each rod extends through the respective nut, spring element and spring plate into the central spring element and is attached the respective spring plate to optimize the oscillation and body sound insulation.

12 Claims, 2 Drawing Sheets

STRUT FOR COUPLING LINEAR DRIVE TO ELEVATOR CAR OR COUNTERWEIGHT

BACKGROUND OF THE INVENTION

The present invention relates generally to elevator drives and, in particular, to a direct drive apparatus for an elevator car.

A linear motor arrangement for an elevator is shown in the European patent document EP 0 846 646, in which a movable part of a linear motor is arranged near a counterweight and is connected with the counterweight by way of a horizontal, non-conductive connection. The movable part of the linear motor is thereby horizontally movable with the counterweight, so that horizontal forces are not transmitted between the motor and the counterweight. The counterweight is guided at a guide rail and the movable part is guided on an adjacent plane. A resilient connecting element between the counterweight and the movable part serves the purpose of avoiding excess allowances which can arise due to the different guidances of the movable part and the counterweight.

In this known solution the oscillations and vibrations arising in the direction of travel are not damped by the described construction of the connecting element.

SUMMARY OF THE INVENTION

The present invention concerns a direct drive arrangement that has the advantage, compared with the state of the art drives, that the oscillations and vibrations arising in the direction of travel are significantly reduced and damped. Advantageously, no disturbing vibrations in the car body are caused by the drive.

A further advantage of the present invention is that the damping properties of the tension/compression strut can be set coarsely and finely. The tension/compression strut is advantageously provided with material transitions in order to undertake not only an oscillation damping function, but also a body sound insulating function.

Of further advantage is the spring behavior of the tension/compression strut independent of direction. This is the same in both directions of loading.

An advantage is further to be seen in that not only the car, but also the counterweight can be used as the driven body of the elevator.

All explained features are usable not only in the respectively indicated combination, but also in other combinations or in isolation with departing from the scope of the present invention.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
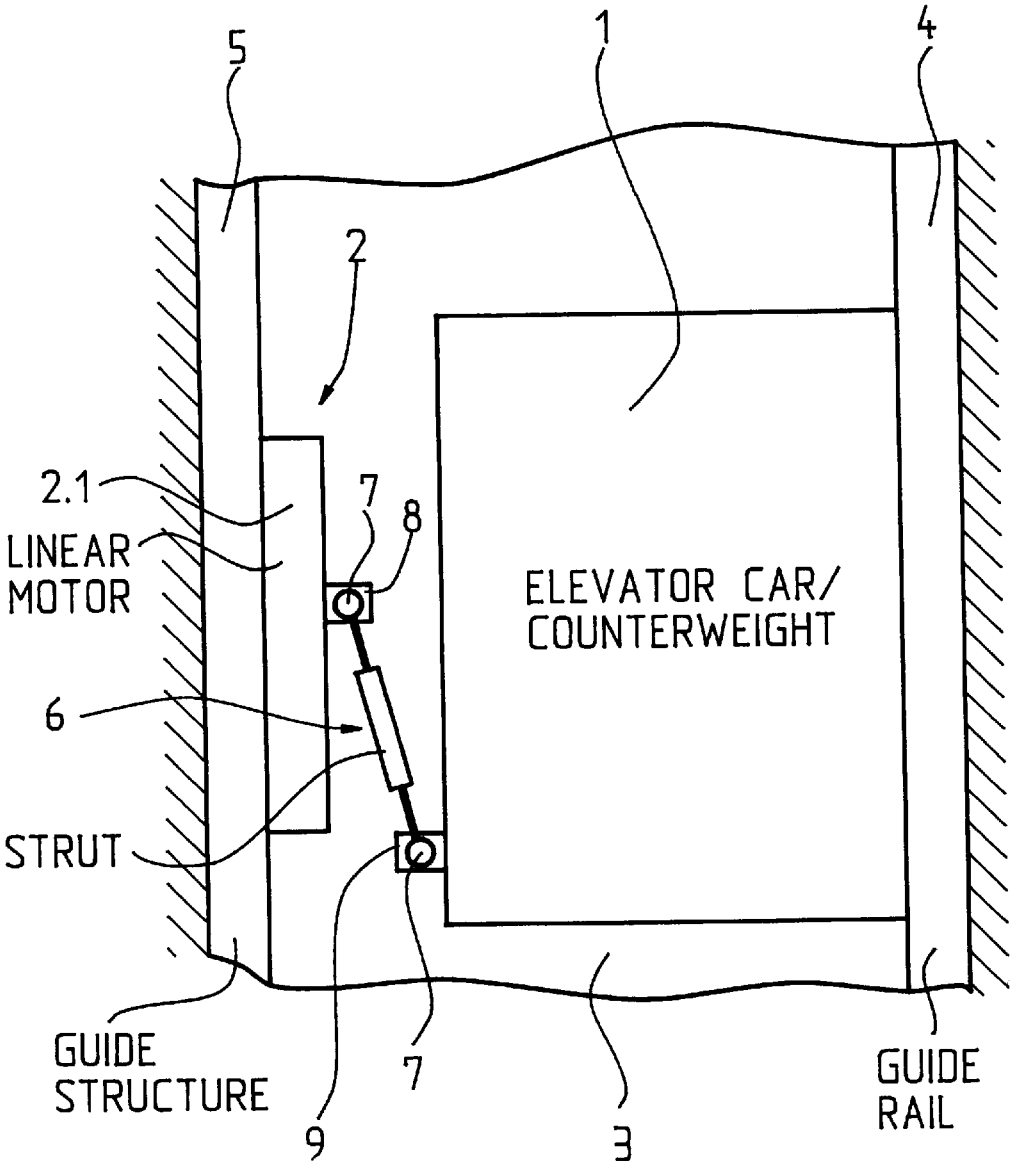
FIG. 1 is a schematic view of the direct drive apparatus according to the present invention.

In FIG. 1 there is illustrated, as a driven body of an elevator, an elevator car (or counterweight) 1 that is guided by means of a direct drive, for example a linear motor 2, on a guide 4, for example a guide rail, which is fastened in an elevator shaft 3, by means of, for example, guide shoes (not shown). A guidance by guide rollers is also possible. The car 1 (or counterweight) can be connected in the usual manner by way of cables and cable rollers, which are not shown, with a counterweight (or car), which is similarly not shown. A movable part 2.1 of the linear motor 2 is in turn guided on a guide structure 5, which is arranged in the elevator shaft 3 and on which a stationary part, which is not shown, of the linear motor is disposed. The guidance can be effected, for example, with the assistance of guide shoes or guide rollers. The thrust forces arising between the stationary part and the movable part 2.1 of the linear motor 2 set the car l in motion. The stationary part 2.1 of the linear motor 2 and the guide structure 5 extend in the elevator shaft 3 over the entire travel path of the linear motor, The arrangement of the guides of the car 1 and the guide structure 5 of the motor 2 in the elevator shaft 3 call be freely selected according to purpose and installation. There is shown in FIG. 1 only one of many possible arrangements, in which the guide 4 of the car 1 lies opposite the guide structure 5 of the motor 2.

The side of the movable part 2.1 of the linear motor 2 that faces the elevator car 1 is connected with one side of the car by means of a resilient, damping tension/compression strut 6, which serves for transmission of compression and tension forces in the direction of travel of the elevator. In the shown variant, the tension/compression strut 6 is fastened by way of ball joints 7 to a first projection 8 of the movable part 2.1 and to a second projection 9 of the car 1. Other modes of fastening the strut 6 to the car 1 and to the motor 2 are also possible.

Figure 2:
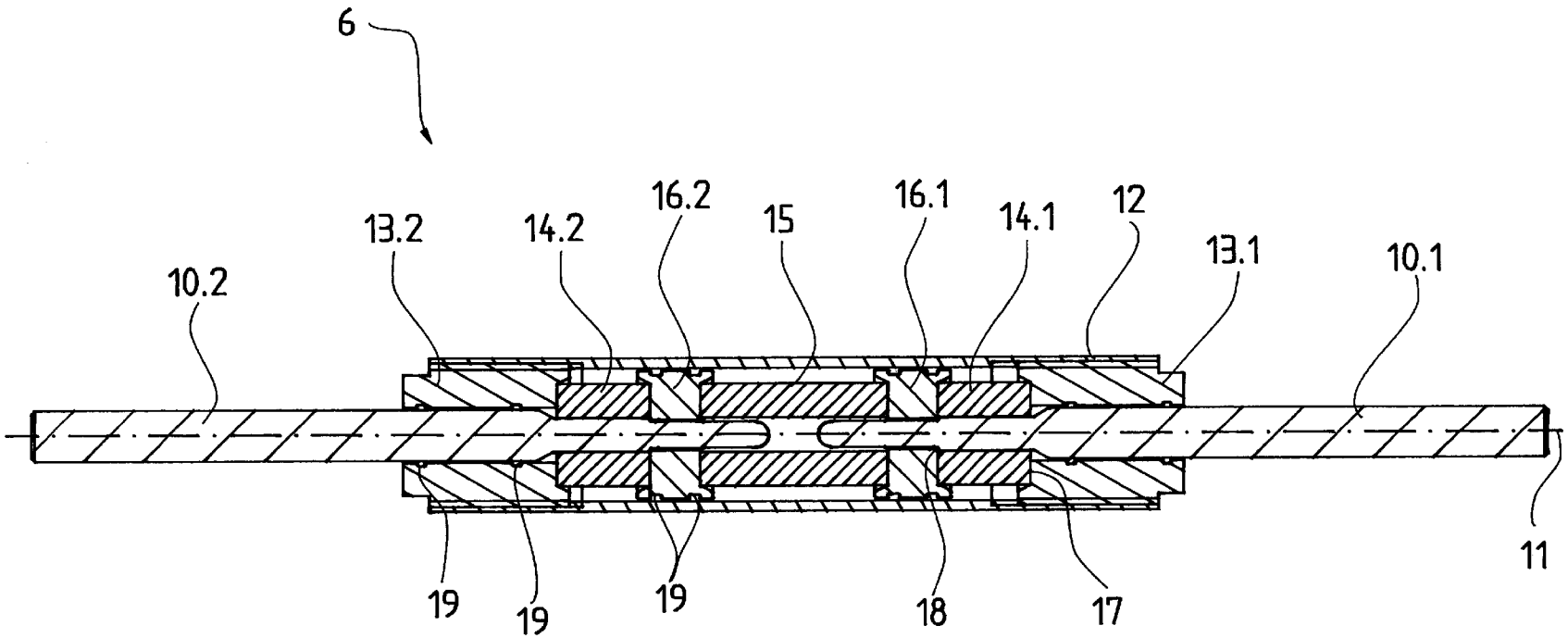
FIG. 2 is an axial sectional view of a tension/compression strut according to the present invention.

The details of the tension/compression strut 6 are shown in the FIG. 2. The tension/compression strut 6 preferably comprises a first rod 10.1 and a second rod 10.2, which lie in a longitudinal axis 11 of the tension/compression strut 6, a sleeve 12 which is, for example, tubular, a first fixing element 13.1 and a second fixing element 13.2, a first spring element 14.1, a second spring element 14.2 and a central spring element 15, as well as a first spring plate 16.1 and a second spring plate 16.2.

In a preferred variant, the first and second fixing elements 13.1 and 13.2 are constructed as nuts and are designated as a first nut 13.1 and a second nut 13.2.

The first and the second nuts 13.1 and 13.2 are each screwed in at a respective one of the ends of the sleeve 12, i.e. at the ends of the sleeve 12 facing the driven body 1 and the movable part 2.1 of the linear motor 2. The sleeve 12 is provided with internal threads which mate with corresponding external threads of the first and second nuts 13.1 and 13.2, respectively. The first and second nuts 13.1 and 13.2 are provided with continuous bores, into which the first and second rods 10.1 and 10.2, respectively, extend. Arranged between the two nuts 13.1 and 13.2 are the first, second and central spring elements 14.1, 14.2 and 15, which in turn are separated by the first and second spring plates 16.1 and 16.2. The first, second and central spring elements 14.1, 14.2 and 15 as well as the first and second spring plates 16.1 and 16.2 are similarly provided with continuous bores, which are traversed by extremities of the first rod 10.1 and the second rod 10.2.

The first nut 13.1, the first spring element 14.1, the first spring plate 16.1 and part of the central spring element 15 lie on the first rod 10.1 within the sleeve 12. The first spring element 14.1 lies between the first nut 13.1 and the first spring plate 16.1, wherein one side of the first spring element

14.1 co-operates with one side of the first nut 13.1 and the other side of the first spring element 14.1 co-operates with one side of the first spring plate 16.1. The same construction also applies to the second rod 10.2. The structure of the tension/compression strut 6 is symmetrical with respect to the center transverse axis of the central spring element 15.

Supports 17, which serve as abutments for the first and second spring elements 14.1 and 14.2, are present on the sides, which face the first and second spring elements 14.1 and 14.2, of the first and second nuts 13.1 and 13.2.

The central spring element 15 is arranged between the first and second spring plates 16.1 and 16.2 and surrounds the extremities of the first and second rods 10.1 and 10.2. The first and second spring plates 16.1 and 16.2 are fixedly connected with the first and second rods 10.1 and 10.2, respectively, for example with the aid of threads. The first and second spring plates 16.1 and 16.2 lie directly against corresponding abutments 18, which are present on the outer surface of the first and second rods 10.1 and 10.2 and which can arise, for example, by an abrupt reduction in the rod diameter. The first and second rods 10.1 and 10.2 are freely movable in the bores of the first and second nuts 13.1 and 13.2, respectively, as well as in the bores of the first, second and central spring elements 14.1, 14.2 and 15.

In order to improve the rigidity of the tension/compression strut 6, slide guides, which are not shown and on which the rods 10.1 and 10.2 can be guided to be stable and secured against high buckling loads, are provided on the inner surfaces of the nuts 13.1 and 13.2 in one possible variant. The extremities of the first and second rods 10.1 and 10.2 extend by a predetermined length into the central spring element 15. A centering of the rods 10.1 and 10.2 is thus guaranteed, even when the rods are withdrawn from the central spring element 15 beyond a predetermined critical point.

In a preferred embodiment, the first, second and central spring elements 14.1, 14.2 and 15 consist of polymer or elastomer and are denoted in the following as first, second and central polymer springs. The first, second and central polymer springs 14.1, 14.2 and 15 have the same properties, wherein the central polymer spring 15 is twice the length compared to the first and second polymer springs 14.1 and 14.2, respectively. This ensures the same spring behavior of the rod in both directions of loading, i.e. in the compression state and the tension state. The spring plates 16.1 and 16.2 consist of a material different from the polymer springs 14.1, 14.2 and 15 and, in fact, the spring plate 16.2 and 16.2 preferably consist of steel. In this manner, the combination of steel spring and polymer spring produces a material transition in the axial direction of the tension/compression strut 6, i.e. parallel to the longitudinal axis 11. A material transition is to be understood as a change in material.

Rings, preferably neoprene rings 19, are present between the first rod 10.1 and the first nut 13.1 and in the same manner between the second rod 10.2 and the second nut 13.2 as well as also around each of the spring plates 16.1 and 16.2 in order to produce, by the combination of neoprene rings and steel, a material transition also in the radial direction of the tension/compression strut 6, i.e. transverse to the longitudinal axis 11.

The mentioned material transition in the tension/compression strut 6 has the effect of obtaining an adequate and effective body sound insulation with high-frequency oscillations in axial and radial directions.

The low-frequency oscillations are damped by the three polymer springs 14.1, 14.2 and 15 biased against one another. Due to the respective use of polymer spring elements with different spring characteristics the oscillation damping can be coarsely preset. As the polymer springs 14.1, 14.2 and 15 preferably exhibit non-linear spring characteristics, the oscillation damping can be finely set by adjustment of the bias of these polymer springs.

The principle of the function of the tension/compression strut 6 is described in the following:

In the unloaded state of the rods 10.1 and 10.2, the polymer springs 14.1, 14.2 and 15 are biased by a predetermined force by way of the spring plates 16.1 and 16.2 via the nuts 13.1 and 13.2 in the sleeve 12. The spring rate can be set by the non-linear characteristics of the polymer springs 14.1, 14.2 and 15.

In the compression state, the rods 10.1 and 10.2 respectively act on the plate springs 16.1 and 16.2 and further, by way of shape locking, on the central polymer spring 15. The central or inner polymer spring 15 is thus compressed and the two other, outer polymer springs 14.1 and 14.2 relieved.

In the tension state, the rods 10.1 and 10.2 respectively act on the spring plate 16.1 and 16.2 and further, by way of shape locking, on the outer polymer springs 14.1 and 14.2. The inner polymer spring 15 is relieved and the outer polymer springs generate a compressive force on the nuts 13.1 and 13.2, respectively. Finally, a tension force on the sleeve 12 arises. The spring rate is the same as in the compression state.

With such construction of the tension/compression strut 6 the oscillation and body sound insulation is optimized in the case of a direct drive of an elevator car.

The rods 10.1 and 10.2 as well as the sleeve 12 preferably have a cylindrical cross section, but other shapes, for example rectangular, etc., are equally conceivable. The same consideration also applies to the polymer springs 14.1, 14.2 and 15, the spring plates 16.1 and 16.2 and the nuts 13.1 and 13.2.

The spring elements 14.1, 14.2 and 15 can consist not only of polymer or elastomer, but also of any kind of resilient material.

The rods 10.1 and 10.2, the sleeve 12, the nuts 13.1 and 13.2 and the spring plates 16.1 and 16.2 preferably consist of steel. Other metals or materials which are appropriate and suitable for the function provided in this invention can equally be used.

With this construction of the tension/compression strut 6 high buckling loads can be absorbed for smallest constructional space. This means that a compact mode of construction is thus obtained with high static and dynamic loads. The tension/compression strut 6 needs only a small constructional space, particularly in relation to its diameter.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for coupling a direct drive to an elevator car movably guided in an elevator shaft, the direct drive apparatus having a movable part guided in the elevator shaft for moving the elevator car, comprising: a tension/compression strut connected at one end to the movable part and connected at an opposite end to a driven body being one of the elevator car and a counterweight connected to the elevator car, said strut transmitting compression and tension forces generated by operation of the direct drive apparatus in a travel direction of the elevator car.

2. The apparatus according to claim 1 wherein said strut includes a pair of resiliently coupled rods, one of said rods being connected to the movable part and another of said rods being connected to the driven body.

3. The apparatus according to claim 1 wherein said strut includes a pair of rods arranged on a common longitudinal axis and each being connected to one of the movable part and the driven body, a sleeve having at least one spring element retained therein, and said rods extending into opposite ends of said sleeve and engaging said at least one spring element.

4. The apparatus according to claim 3 including at least one fixing element attached to one of said ends of said sleeve for retaining said at least one spring element in said sleeve.

5. The apparatus according to claim 1 wherein said tension/compression strut includes a pair of rods lying on a common axis and each being connected to one of the movable part and the driven body, a sleeve, a pair of fixing elements attached to opposite ends of said sleeve, a central spring element in said sleeve, first and second spring elements each positioned in said sleeve between said central spring element and an associated one of said fixing elements, and first and second spring plates each positioned in said sleeve between said central spring element and an associated one of said first and second spring elements.

6. The apparatus according to claim 5 wherein said central spring element and said first and second spring element have similar spring properties, and said central spring element is approximately twice as long as either of said first and second spring elements.

7. The apparatus according to claim 5 wherein at least one of said central spring element and said first and second spring elements has non-linear spring characteristics, and wherein a bias of the tension/compression strut can be set by movement of at least one of said fixing elements relative to said sleeve.

8. The apparatus according to claim 5 wherein said central spring element and said first and second spring elements are formed of a polymer material and said spring plates are formed of a steel material, thereby producing a material transition in a longitudinal direction of the tension/compression strut.

9. The apparatus according to claim 5 including at least one resilient ring positioned between at least one of said rods and said associated fixing element to provide a material transition transversely to a longitudinal axis of the tension/compression strut.

10. The apparatus according to claim 5 including at least one resilient ring positioned between at least one of said spring plates an d said sleeve to provide a material transition transversely to a longitudinal axis of the tension/compression strut.

11. The apparatus according to claim 1 wherein the tension/compression strut has a same spring characteristic when loaded in tension and as when loaded in compression.

12. A strut for coupling a direct drive apparatus to an elevator car movably guided in an elevator shaft, the direct drive apparatus having a movable part guided in the elevator shaft for moving the elevator car, the strut comprising:

a sleeve having a longitudinal axis; first and second fixing elements each being attached to an associated one of opposite ends of said sleeve;

a central spring element in said sleeve;

first and second spring elements each positioned in said sleeve between said central spring element and an associated one of said first and second fixing elements;

first and second spring plates each positioned in said sleeve between said central spring element and an associated one of said first and second spring elements; and first and second rods each extending along said longitudinal axis of said sleeve through associated ones of said first and second fixing elements, said first and second spring elements and said first and second spring plates and into said central spring element whereby when said first and second rods are connected to respective ones of the movable part and the driven body, compression and tension forces generated by operation of the direct drive apparatus are transmitted in a travel direction of the elevator car.

* * * * *